United States Patent [19]

Sylvest, II

[11] Patent Number: 4,619,475

[45] Date of Patent: Oct. 28, 1986

[54] DRUM LIFTING APPARATUS

[75] Inventor: Lawrence E. Sylvest, II, Franklinton, La.

[73] Assignee: Conoco Inc., Ponca City, Okla.

[21] Appl. No.: 742,984

[22] Filed: Jun. 10, 1985

[51] Int. Cl.[4] ..... B66C 1/42

[52] U.S. Cl. ..... 294/90; 294/67.3; 294/103.1

[58] Field of Search ..... 294/4, 16, 34, 62, 63.1, 294/67.3, 67.33, 81.1–81.5, 81.54, 81.56, 81.62, 85, 86.41, 90, 92, 103.1, 103.2, 104, 119.1; 269/240, 243, 245, 248

[56] References Cited

U.S. PATENT DOCUMENTS

| | | | |
|---|---|---|---|
| 680,591 | 8/1901 | Hoelsche | 294/62 |
| 1,208,500 | 12/1916 | Crites et al. | 294/34 X |
| 1,530,361 | 3/1925 | Harris | 269/243 X |
| 2,176,251 | 10/1939 | Duhan | 294/90 |
| 2,510,596 | 6/1950 | Murphy | 294/16 X |
| 2,515,918 | 7/1950 | Weeks et al. | 294/67.33 |
| 2,638,063 | 5/1953 | Clark | 294/85 X |
| 2,794,666 | 6/1957 | Bishman | 294/103.1 X |
| 2,909,153 | 10/1959 | McKinley et al. | 294/103.1 X |
| 3,033,559 | 5/1962 | Lindholm | 269/240 X |
| 3,085,553 | 4/1963 | Anderson | 294/103.1 X |
| 3,100,123 | 8/1963 | Schmidt | 294/103.1 X |
| 3,414,311 | 12/1968 | Trimboli | 294/34 |
| 3,415,564 | 12/1968 | Childers | 294/103.1 |
| 4,256,429 | 3/1981 | Dwyer | 294/103.1 X |

FOREIGN PATENT DOCUMENTS

| | | | |
|---|---|---|---|
| 2815532 | 10/1979 | Fed. Rep. of Germany | 294/85 |
| 5551 | 5/1850 | France | 294/103.1 |
| 155724 | 6/1982 | German Democratic Rep. | 294/103.1 |
| 248949 | 1/1970 | U.S.S.R. | 294/103.1 |

OTHER PUBLICATIONS

Exhibit "A"—cover and pp. 116–121 and 124 of catalog of Global Equipment Company entitled Industrial Products Buyer's Guide 88B.

*Primary Examiner*—Johnny D. Cherry

*Attorney, Agent, or Firm*—Richard K. Thomson

[57] ABSTRACT

A drum lifting apparatus includes a lifting beam having first and second ends. A first flange is fixedly attached to the first end of the beam and extends laterally therefrom. A first drum lip engagement extends from the first flange for engaging an annular lip of a first end of the drum. A second end of the beam has a shoulder defined thereon and has a threaded rod fixedly attached to the beam and extending from the shoulder. A releasable second flange has an opening therethrough through which the threaded rod is loosely received so that the second flange may slide on the rod and engage the shoulder of the lifting beam. The second flange extends laterally from the rod and has a second drum lip engagement extending therefrom toward the first flange for engaging a second annular lip on a second end of the drum. A threaded nut engages the threaded rod on a side of the second flange opposite the shoulder of the lifting beam for clamping the second flange against the end of the drum. A lifting eye is fixedly attached to the lifting beam substantially midway between the first and second ends of the beam for engagement by a crane or the like.

16 Claims, 4 Drawing Figures

DRUM LIFTING APPARATUS

BACKGROUND OF THE INVENTION

1. Field of the Invention

The present invention relates to apparatus for lifting drums, and more particularly, to an apparatus constructed for lifting a standard fifty-five-gallon oil drum with a crane or the like.

2. Description of the Prior Art

In the oil field, a great many materials are handled and transported by placing such materials in a fifty-five-gallon steel drum.

When it is necessary to move materials contained in such drums, they are typically handled with a crane or the like. This is particularly true when drums are being moved from one elevation to another in a situation such as is present on an offshore drilling rig where materials are continually being loaded off of and onto barges and the like which transport the materials to the offshore rig.

The most common way of handling these drums with a crane is to place a sling about the circumference of the drum and to attach a hook from the crane to the sling. One problem with the use of such slings, however, is that unless great care is taken, the drum can inadvertently slip from the sling thus presenting a significant danger.

The prior art does include devices which provide a clamping type engagement with such a drum as a substitute for a sling. One such device is shown in U.S. Pat. No. 3,415,564 to Childers which discloses a drum hoisting beam. The Childers device includes a beam having a fixed jaw at one end for engaging a lip of one end of the drum, and a spring-biased, cam-actuated movable jaw at the other end for engaging a lip at the second end of the drum.

SUMMARY OF THE INVENTION

The present invention provides a drum lifting apparatus which is constructed to achieve a positive locking engagement with the drum which cannot be unintentionally released, thus providing the maximum safety in such a device.

The drum lifting apparatus of the present invention includes a lifting beam having first and second ends.

A fixed first flange is fixedly attached to the first end of the beam. A first drum lip engagement means extends from the first flange substantially parallel to the beam in a first direction from the first end of the beam toward the second end of the beam for engaging a first annular lip on the first end of the drum.

A second end of the beam has a shoulder defined thereon facing in said first direction. A distance parallel to the beam between the shoulder and an inner surface of the first flange is less than a length of the drum to be lifted. A threaded rod is fixedly attached to the beam and extends in said first direction from said shoulder of the second end of the beam.

A releasable second flange has an opening therethrough through which the rod is loosely received, so that the second flange may slide on the rod and may engage the shoulder of the beam. The second flange extends laterally from the rod and has a second drum lip engagement means extending therefrom in a second direction substantially opposite the first direction for engaging a second annular lip on a second end of the drum.

A first threaded nut means is threadedly engaged with the threaded rod on a side of the second flange opposite the shoulder of the lifting beam for tightening the second flange against the second end of the drum.

A lifting eye means is fixedly attached to the lifting beam substantially midway between the first and second ends of the lifting beam for engagement by a crane or the like for lifting the drum lifting apparatus and the drum.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
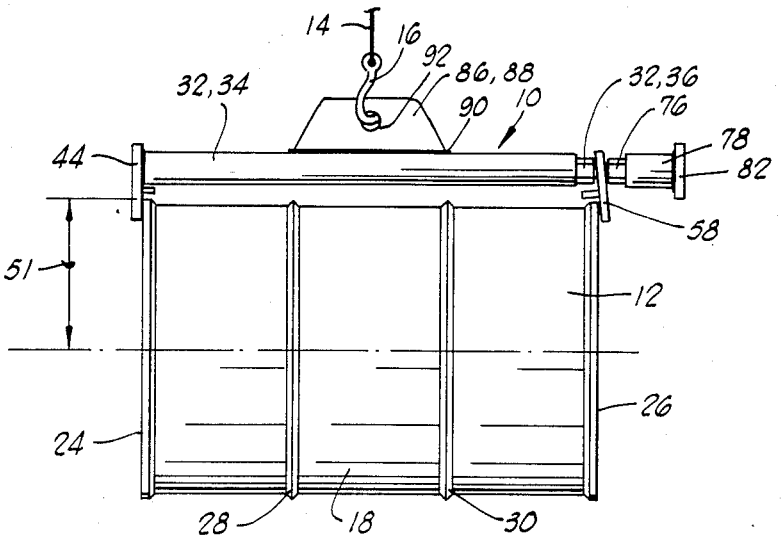
FIG. 1 is a side elevation view of the drum lifting apparatus of the present invention connected to a standard fifty-five-gallon drum, and having a hook from a lifting cable of a crane engaged with the lifting eye of the drum lifting apparatus.

Referring now to the drawings, and particularly to FIG. 1, the drum lifting apparatus of the present invention is shown and generally designated by the numeral 10. The apparatus 10 is shown clamped in place about a standard fifty-five-gallon oil drum 12. A cable 14 and attached hook 16 of a crane (not shown) or the like is shown attached to the drum lifting apparatus 10.

Figure 2:
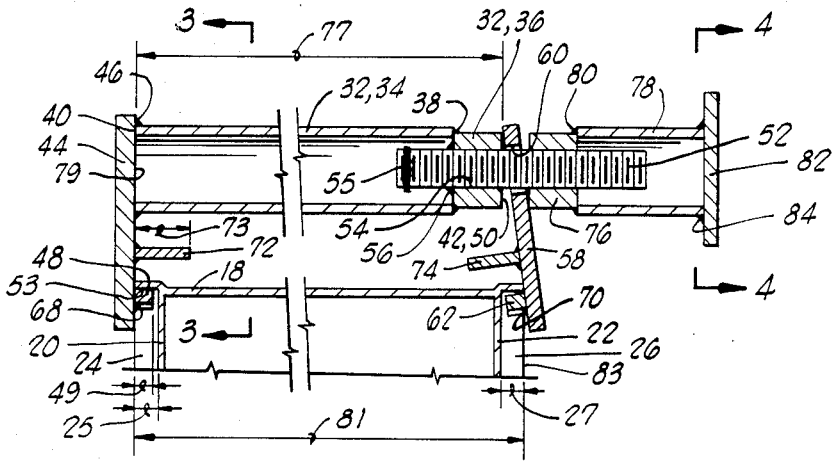
FIG. 2 is a section elevation view of the drum lifting apparatus of FIG. 1.

The conventional fifty-five-gallon drum 12 has a cylindrical outer wall 18 and closed first and second end walls 20 and 22 (see FIG. 2). First and second annular lips 24 and 26 extend past the first and second end walls 20 and 22 of the drum 12 by distances of approximately $\frac{3}{4}$ inch as indicated at 25 and 27, respectively, in FIG. 2. Two reinforcing ribs 28 and 30 are formed at intermediate locations along the length of the drum 12.

The lifting apparatus 10 includes a lifting beam 32. The lifting beam 32, in a preferred embodiment, is constructed from a length of two-inch nominal diameter hollow cylindrical steel pipe 34 having a large diameter threaded fixed nut 36 concentrically aligned therewith and attached to an end thereof at weld 38.

Lifting beam 32 has first and second ends 40 and 42. A fixed first flange 44 is fixedly attached to first end 40 of lifting beam 32 at weld 46 and extends laterally from lifting beam 32.

First flange 44 has a first drum lip engagement means 48 extending from first flange 44 substantially parallel to the beam 32 in a first direction from first end 40 toward second end 42 of beam 32 for engaging the first annular lip 24 of drum 12 as seen in FIG. 2. First drum lip engagement means 48 extends a distance 49 no greater than the length 25 of annular lip 24, i.e., no greater than $\frac{3}{4}$ inch.

Figure 3:
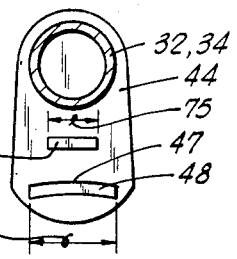
FIG. 3 is a section view taken along line 3—3 of FIG. 2 showing the construction of the fixed first flange.

As seen in FIG. 3, the first drum lip engagement means 48, when viewed from a direction substantially parallel to the beam 32, has an arcuate upper profile 47 which has a radius of curvature substantially equal to a radius 51 of drum 12.

This shape of first drum lip engagement means 48 allows its upper profile 47 to closely engage a radial inner surface 53 of first annular lip 24.

The first drum lip engagement means 48 is constructed from ⅜-inch thick steel plate or keystock, and as viewed in FIG. 3, the arcuate upper surface 47 has a length 45 of approximately three inches. A weld 68 runs all the way around the first drum lip engagement means 48 at its intersection with first flange 44.

The second end 42 of beam 32 has an annular shoulder 50 defined thereon, which in the disclosed embodiment is an annular end face of the large diameter nut 36, which shoulder 50 faces in said first direction.

A threaded rod 52 is fixedly attached to the beam 32 and extends in said first direction from the shoulder 50 of second end 42 of beam 32. Threaded rod 52 is, in a preferred embodiment, a threaded stud bolt which threadedly engages the large diameter nut 36 at threaded engagement 54 and is back-welded to large diameter nut 36 as indicated at 56.

The back-weld 56 may be referred to as a retaining means 56 for preventing the threaded rod 52 from being disengaged from the threaded nut 36. Other suitable retaining means could be provided by placing a weld bead around the circumference of the threaded rod 52 itself as indicated at 55, in which case the weld 56 directly between the rod 52 and nut 36 could be eliminated.

A releasable second flange 58 has an opening 60 therethrough through which the rod 52 is loosely received so that the second flange 58 may slide on rod 52 and may engage the shoulder 50 as shown in FIG. 2.

The releasable second flange 58 extends laterally from the rod 52 and has a second drum lip engagement means 62 extending from the second flange 58 in a second direction substantially opposite the previously mentioned first direction for engaging the second annular lip 26 extending from second end wall 22 of drum 12. Second drum lip engagement means 62 is constructed similar to first drum lip engagement means 48 previously described, and is welded at 70 to second flange 58.

The first and second flanges 44 and 58 also include drumstops 72 and 74, respectively. First annular lip 24 of drum 12 is located between first drum lip engagement means 48 and drumstop 72 on first flange 44, and second annular lip 26 is located between second drum lip engagement means 62 and drumstop 74 on second flange 58. Drumstop 72 is constructed from ⅜-inch thick keystock or plate and extends a distance 73 of approximately 1½ inches beyond first flange 44 and has a length 75 when viewed in FIG. 3 of approximately 1½ inches. Second drumstop 74 is similarly constructed. The drumstops 72 and 74 serve to prevent the outer wall 18 of drum 12 from engaging the beam 32 so as to aid in the positioning of drum 12 relative to the apparatus 10 prior to the tightening of second flange 58 against the drum 12.

A rotatable threaded nut means 76 is threadedly engaged with the threaded rod 52 on a side of second flange 58 opposite the shoulder 50 of lifting beam 32 for clamping the second flange 58 against the drum 12 by tightening the threaded nut means 76 on the threaded rod 52 against the second flange 58 as shown in FIG. 2.

A distance 77 parallel to lifting beam 32 between the shoulder 50 and an inner surface 79 of first flange 44 is equal to 34½ inches which is less than a length 81 of a standard 55-gallon drum which is 35¼ inches.

As is apparent in FIGS. 1 and 2, the opening 60 in second flange 58 has a clearance about the threaded rod 52 sufficiently great that the second flange 58 can be tilted away from a radially extending orientation relative to the threaded rod 52 so that the second flange 58 can engage both the shoulder 50 of beam 32 and end 83 of drum 12 corresponding to second annular lip 26 at the same time, even though the length 81 of drum 12 is greater than the distance 77 between the shoulder 50 and inner surface 79 of first flange 44.

This construction assures that even if the length 81 of drum 12 is slightly more or less than its nominal dimension of 35¼ inches, the second flange 58 will still be tightly clamped against the end 83 of the drum, with the other end of the drum being tightly clamped against first flange 44.

Preferably, opening 60 of second flange 58 has a radial clearance of approximately ¼ inch around the threaded rod 52.

When the threaded nut means 76 is made up on rod 52 to tightly clamp second flange 58 against the end 83 of drum 12, the drum 12 is securely gripped between flanges 44 and 58 with the first and second drum lip engagement means 48 and 62, respectively securely in place under the first and second annular lips 24 and 26 of drum 12. Thus the drum 12 is securely attached to the lifting apparatus 10 and cannot come loose therefrom unless such a force is exerted as to shear off one of the drum lip engagement means 48 or 62, or to rupture the annular lips 24 or 26 of drum 12.

A short length of cylindrical pipe 78 is attached to threaded nut means 76 at weld 80 and serves as a thread protector 78 to protect the threads of threaded rod 52 from damage as the drum lifting apparatus 10 is utilized. It will be appreciated that the lifting apparatus 10 is often subject to considerable physical abuse as drums are moved about a typical oil field location, and it is important that it be constructed in a sturdy fashion.

Figure 4:
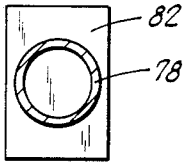
FIG. 4 is a section view taken along line 4—4 showing the construction of the operating handle of the drum lifting apparatus.

Attached to a free end of thread protector 78 is a rectangular operating handle 82 which is connected to thread protector 78 at weld 84. The shape of handle 82 is best seen in FIG. 4.

The handle 82 can be grasped by the hand of a human operator and used to tighten the large diameter nut 76 against the releasable second flange 58 and of course also to release the same when desired.

The releasable second flange 58 is free to rotate about the threaded rod 52 when the threaded nut means 76 is backed off from clamping engagement with the second flange 58.

As seen in FIG. 1, a lifting eye means 86 is constructed from a section of steel plate 88 welded at 90 to the lifting beam 32 and having a lifting eye 92 therethrough for engagement with the hook 16 from a crane. The lifting eye means 86 is attached to the lifting beam 32 substantially midway between the first and second ends 40 and 42 of the lifting beam 32.

When the apparatus 10 is used, the drum 12 will normally be laid on its side, and the nut 76 will be loosened so that the second flange 58 can slide back away from the shoulder 50 in order to allow the same to be placed over the second lip 26 of drum 12.

Then, the first lip 24 of drum 12 is placed between the first drum lip engagement means 48 and drumstop 72 of first flange 44, and the releasable second flange 58 is moved to a position with the second annular lip 26 of drum 12 in place between the second drum lip engagement means 62 and drumstop 74 of second flange 58. Then the nut 76 is tightly made up against the second flange 58 to clamp it tightly against the end 83 of drum 12 by rotation of the nut 76 through use of the operating handle 82.

Then, a crane or the like is attached to the lifting apparatus 12 by connecting its hook 16 through the eye 92 of lifting eye means 86. The drum 12 may then be lifted and moved to a desired location.

Thus it is seen that the apparatus of the present invention readily achieves the ends and advantages mentioned as well as those inherent therein. While certain preferred embodiments of the present invention have been illustrated for the purposes of the present disclosure, numerous changes in the arrangement and construction of parts may be made by those skilled in the art, which changes are encompassed within the scope and spirit of the present invention as defined by the appended claims.

What is claimed is:

1. An apparatus for lifting a drum which has a particular length, said apparatus comprising:

a lifting beam having first and second ends;

a fixed first flange fixedly attached to said first end of said beam and extending laterally therefrom and having a first drum lip engagement means extending from said first flange substantially parallel to said beam in a first direction from said first end toward said second end of said beam, for engaging a first annular lip on a first end of said drum;

said second end of said beam having a shoulder defined thereon facing in said first direction, a distance parallel to said lifting beam between said shoulder and an inner surface of said first flange being less than the length of said drum;

a threaded rod fixedly attached to said beam and extending in said first direction from said shoulder of said second end of said beam;

a releasable second flange having an opening therethrough through which said rod is loosely received, so that said second flange may slide on said rod and may engage said shoulder, said second flange extending laterally from said rod and having a second drum lip engagement means extending from said second flange in a second direction substantially opposite said first direction for engaging a second annular lip on a second end of said drum, said opening in said second flange having a sufficient clearance about said threaded rod that said second flange can be tilted away from a radially extending orientation relative to said threaded rod to facilitate engagement and disengagement of said second lip engaging means with said second annular lip;

a first threaded nut means threadedly engaged with said threaded rod on a side of said second flange opposite said shoulder of said lifting beam, for tightening said second flange against said second end of said drum; and lifting eye means, fixedly attached to said lifting beam substantially midway between said first and second ends of said lifting beam, for engagement by a crane or the like for lifting said drum lifting apparatus and said drum.

2. The apparatus of claim 1, wherein:

said second flange is free to rotate about said threaded rod when said first threaded nut means is backed off from said second flange.

3. The apparatus of claim 1, wherein;

said clearance about said threaded rod is sufficient to permit said second flange to tilt into engagement with both said shoulder and said second end of said drum at the same time, even though said length of said drum is greater than said distance between said shoulder and said inner surface of said first flange.

4. The apparatus of claim 1, wherein:

said lifting beam includes as a major portion thereof a length of hollow cylindrical pipe.

5. The apparatus of claim 4, wherein:

said lifting beam also includes a second threaded nut concentrically aligned with said pipe and welded to an end thereof, a free end of said second threaded nut defining said shoulder of said second end of said beam; and said threaded rod is threadedly engaged with said second threaded nut.

6. The apparatus of claim 5, further comprising:

means for preventing said threaded rod from being disengaged from said second threaded nut.

7. The apparatus of claim 4, wherein:

said first flange is constructed from flat plate and is welded to an end of said pipe.

8. The apparatus of claim 1, wherein:

said first drum lip engagement means, when viewed from a direction substantially parallel to said lifting beam, has an arcuate upper profile with a radius of curvature substantially equal to a radius of said drum.

9. The apparatus of claim 1, wherein:

said first drum lip engagement means extends from said first flange a distance no greater than a length of said first annular lip of said drum parallel to a longitudinal axis of said drum.

10. The apparatus of claim 1, wherein:

said lifting eye means includes a flat plate oriented substantially parallel to said lifting beam and welded thereto, said plate having a lifting eye opening formed therein.

11. A drum lifting apparatus comprising:

a length of hollow cylindrical pipe having a first end and a second end;

a fixed first flange, constructed from flat plate and welded to said first end of said pipe, said first flange extending laterally from said pipe;

a first drum lip engagement means extending from said first flange substantially parallel to a length of said pipe in a first direction from said first end toward said second end of said pipe;

a fixed threaded nut concentrically aligned with said pipe and welded to said second end thereof;

a threaded rod threadedly engaged with said fixed threaded nut and extending in said first direction from said fixed threaded nut;

a releasable second flange, constructed from flat plate, and having an opening therethrough through which said threaded rod is received, said second flange having a second drum lip engagement means extending from said second flange in a second direction substantially opposite said first direction; and a rotatable threaded nut, threadedly engaged with said threaded rod on a side of said second flange opposite said fixed threaded nut.

12. The apparatus of claim 11, wherein:

said first drum lip engagement means, when viewed in said second direction, has an arcuate upper profile.

13. The apparatus of claim 11, further comprising:

means for preventing said threaded rod from being disengaged from said fixed threaded nut.

14. The apparatus of claim 11, wherein:

said opening of said second flange is circular and is sufficiently large that said threaded rod is loosely received therein.

15. The apparatus of claim 11, further comprising:

lifting eye means, fixedly attached to said pipe substantially midway between said first and second ends thereof.

16. A drum lifting apparatus for lifting a standard 55-gallon drum having a length of approximately 34¼ inches, comprising;

a lifting beam having first and second ends, said lifting beam having a length between said first and second ends of approximately 34½ inches;

a fixed first flange fixedly attached to said first end of said beam and extending laterally therefrom;

a first drum lip engagement means extending no greater than ¾ inch from said first flange in a first direction from said first end toward said second end of said beam;

said second end of said beam having a shoulder thereon facing in said first direction;

a threaded rod fixedly attached to said beam and extending in said first direction from said shoulder of said second end of said beam;

a releasable second flange having an opening therethrough through which said rod is loosely received, said second flange extending laterally from said rod and having a second drum lip engagement means extending no greater than ¾ inch from said second flange in a second direction substantially opposite said first direction, said opening in said flange having a sufficient clearance about said threaded rod to permit said second flange to be tilted away from a radially extending orientation relative to said threaded rod; and threaded nut means, threadedly engaged with said threaded rod on a side of said second flange opposite said shoulder of said lifting beam, for tightening against said second flange to clamp said drum between said first and second flanges, said first and second drum lip engagement means being secured beneath first and second lips of said drum.

* * * * *